US006284356B1

(12) United States Patent
Kiriyama

(10) Patent No.: US 6,284,356 B1
(45) Date of Patent: Sep. 4, 2001

(54) ALUMINUM OXIDE-COATED TOOL MEMBER

(75) Inventor: Seiji Kiriyama, Kanagawa (JP)

(73) Assignee: Toshiba Tungaloy Co., Ltd., Kawasaki (JP)

( * ) Notice: Subject to any disclaimer, the term of this patent is extended or adjusted under 35 U.S.C. 154(b) by 0 days.

(21) Appl. No.: 09/288,645

(22) Filed: Apr. 9, 1999

(30) Foreign Application Priority Data

Jul. 29, 1998 (JP) ..... 10-214324

(51) Int. Cl.[7] ..... B22B 9/00

(52) U.S. Cl. ..... 428/216; 51/307; 51/309; 428/336; 428/697; 428/698; 428/699; 428/701; 428/702

(58) Field of Search ..... 428/697, 688, 428/699, 701, 702, 216, 336; 51/607, 309

(56) References Cited

U.S. PATENT DOCUMENTS

| | | | | |
|---|---|---|---|---|
| 4,447,263 | * | 5/1984 | Sugizawa et al. | 75/233 |
| 4,714,660 | * | 12/1987 | Gates, Jr. | 428/699 |
| 4,970,092 | * | 11/1990 | Gavrilov et al. | 427/38 |
| 5,549,975 | * | 8/1996 | Schulz et al. | 428/553 |
| 5,879,823 | * | 3/1999 | Prizzi et al. | 428/698 |

FOREIGN PATENT DOCUMENTS

| | | | |
|---|---|---|---|
| 0 263 747 | | 4/1988 | (EP) . |
| 0 448 720 | * | 10/1991 | (EP) . |

OTHER PUBLICATIONS

Database WIP; Week Apr. 1981; Derwent Publications Ltd.; JP 55 148764 A; Nov. 19, 1980.
Database WPI; Week Mar. 1980; Derwent Publications Ltd.; JP 54 153758 A; Abstract.

* cited by examiner

*Primary Examiner*—Archene Turner
(74) *Attorney, Agent, or Firm*—Foley & Lardner

(57) ABSTRACT

Disclosed is an aluminum oxide coated tool member which comprises a substrate, an intermediate layer containing elements of Al, Ti, O and C provided on the substrate and an outer layer adjacent to the intermediate layer, wherein the outer layer comprises $Al_2O_3$, and the intermediate layer comprises at least one layer selected from the group consisting of a single-phase layer of a composite carboxide containing Ti and Al, and a complex-phase layer in which at least two selected from the group consisting of TiC, TiN, Ti(C,N), Ti(C,O), Ti(N,O), Ti(C,N,O), $Al_2O_3$, AlN, Al(O,N), Al(O,C), Al(O,N,C), a composite nitride containing Ti and Al, a composite oxide containing Ti and Al, a composite carboxide containing Ti and Al, a composite nitroxide containing Ti and Al, and a composite carbonitroxide containing Ti and Al are dispersed.

11 Claims, No Drawings

ALUMINUM OXIDE-COATED TOOL MEMBER

BACKGROUND OF THE INVENTION

1. Field of the Invention

This invention relates to an aluminum oxide-coated tool member in which a coating layer of aluminum oxide excellent in peeling resistance is coated on a substrate of metal, an alloy or a ceramics sintered body whereby lifetime of the tool is elongated. More specifically, the present invention relates to an aluminum oxide-coated tool member in which an intermediate layer is interposed between the substrate of metal, an alloy or a ceramics sintered body and an aluminum oxide-coated layer in view of difference in thermal expansion and suitability at the interfaces, which is most suitable for cutting tools such as turning tools, milling tools, drills and end mills; shaping tools such as dies and punches; wear resistant tools such as cutting blades including slitter, and cutting blades; corrosion resistant and wear resistant tools such as nozzles and coating tools; tools for the civil engineering and construction industry represented by cutting tools, digging tools, drilling tools and pulverizing tools to be used for a mine, road and construction.

2. Prior Art

A coated member comprising a substrate of metal, an alloy or a ceramics sintered body, and a coated layer provided thereon which is harder than the support by using a chemical vapor deposition method (CVD method), a physical vapor deposition method (PVD method) or a plasma CVD method whereby synergistic effects of the strength and toughness of the substrate and wear resistance of the coated material are developed has heretofore been used in practical. At present, representative materials of the coated layer in the coated material which have been practically used may include a Ti element-containing coated layer such as a nitride, carbide or carbonitride of Ti, a composite nitride or a composite carbonitride of Ti and Al; and an aluminum oxide coated layer.

Among these coated members, a number of coated members in which a coated layer of aluminum oxide is coated on a substrate whereby characteristics of the aluminum oxide are effectively utilized whereby long life time is established has been proposed. When a coated member in which a coating layer of aluminum oxide is coated on a substrate is used as a tool, if it is used as a cutting tool used at a high temperature under severe conditions, an adhesiveness between the substrate and the aluminum oxide coating layer is to be improved. In Japanese Provisional Patent Publication No. 256503/1992, a material to solve the above problems has been disclosed. Also, as a prior art technique regarding an oxicarbide of Ti and Al which is not directly relevant to the issue of adhesiveness between the substrate and the coated layer of aluminum oxide, there may be mentioned J. Vac. Sci. Tech. A(4)6 1986, pp. 2707 to 2712.

Among the prior art techniques regarding aluminum oxide-coated tool member in which a coating layer of aluminum oxide is coated on a substrate, in Japanese Provisional Patent Publication No. 256503/1992, there is disclosed a cutting tip made of a surface-coated tungsten carbide-base hard alloy excellent in peeling resistance which comprises an inner layer composed of a single-phase layer or multi-layers of at least one Ti compound selected from a carbide, nitride, carbonitride and carbonitroxide of Ti, an intermediate layer and an outer layer of aluminum oxide are successively coated on the surface of a tungsten carbide-base hard alloy substrate, and the intermediate layer is a mixed layer of the inner layer and the outer layer.

The surface-coated cutting tip disclosed in said publication employs an intermediate layer comprising a mixed layer of the inner layer and the outer layer so that peeling caused by strain in difference between thermal expansions at the whole surfaces of the respective layers is relaxed. However, there is not so remarkable relaxing effects on strain due to difference in thermal expansion at the tip of the blade of the cutting tip, particularly at the minute surface area of the cutting blade and there remains a problem that suitability of the outer layer and the intermediate layer is not in optimum conditions. Also, in the surface-coated cutting tip disclosed in said reference, among the components of the intermediate layer, the portion comprising the components of the inner layer is inferior in adhesiveness to the outer layer so that there is a problem that not so much effects can be expected about the adhesiveness between the intermediate layer and the outer layer.

As a method for coating the intermediate layer, there is disclosed that "a zone time of the inner layer and a zone time of the outer layer are each made 30 seconds and these layers are alternatively formed repeatedly" in Examples of said reference. According to this method, a layer of the inner layer components and a layer of the outer layer components are alternatively laminated with extremely thin layers, and thus, there is a problem that an effect of a mixed layer in which inner layer components and outer layer components are present in admixture in one layer cannot be obtained. Moreover, according to the method disclosed in said reference, there are problems that film forming operations at the forming step of the coating layer becomes complex, and it is necessary to additionally install a device for effecting film formation.

In J. Vac. Sci. Tech. A(4)6 1986, pp. 2707 to 2712 mentioned as another prior art techniques, there is disclosed an example in which a coating layer of $Ti_wAl_xO_yC_z$ is formed on a TiC film by the CVD method and an amount of Al in the coating layer is made 3 to 58% whereby the resulting tool is used as a cutting tool. In said prior art reference, comparison between wear resistance in cutting tests using the $Ti_wAl_xO_yC_z$-coated layer and the conventional TiC coated layer, TiC-$Al_2O_3$ laminated layer, etc. have been done. However, this reference is silent about the relationship between the $Ti_wAl_xO_2C_z$-coated layer and the $Al_2O_3$-coated layer.

SUMMARY OF THE INVENTION

The present invention has solved the above-mentioned problems and an object thereof is to provide an aluminum oxide-coated tool member in which elongation of a lifetime of the tool is accomplished by fully drawing out the excellent characteristics of the aluminum oxide coating layer at high temperature region and heightening peeling resistance of the coating layer, particularly the coating layer of aluminum oxide, having high toughness, high hardness, wear resistance, oxidation resistance, thermal shock resistance, fracture resistance and temperature adhesion resistance, and improving temperature adhesion resistance with a material to be cut.

The present inventor has earnestly studied for a long period of term about peeling resistance of an aluminum oxide-coating layer in a coated hard alloy in which a coating layer of aluminum oxide is coated on the surface of a substrate of a hard alloy and found the following first to fifth findings whereby accomplished the present invention. The first finding is that difference in thermal expansions between the substrate and the aluminum oxide-coating layer of the aluminum oxide-coated hard alloy exerts remarkable effects on peeling resistance of the aluminum oxide-coating layer. The second finding is that when a substance adjacent to the aluminum oxide-coating layer comprises a composite carboxide containing Ti and Al, a mixed substance in which aluminum oxide is dispersed in a composite carboxide containing Ti and Al, or a mixed substance in which aluminum oxide is dispersed in a composite carbonitroxide containing Ti and Al, the substance has an optimum adhesive property with aluminum oxide. The third finding is that when a gas which becomes a supplying source of Al is introduced at the time of forming a film of a titanium carboxide layer, under suitable conditions at film formation, Al is incorporated into titanium carboxide at the time of film formation reaction whereby a single-phase layer of a composite carboxide containing Ti and Al, or a complex-phase layer in which aluminum oxide is dispersed in a composite carboxide containing Ti and Al is formed. The fourth finding is that when a nitrogen-containing gas is introduced in a starting gas, a complex-phase layer in which aluminum oxide is dispersed in a composite carbonitroxide containing Ti and Al is formed. The fifth finding is that, by using the above single-phase layer or the complex-phase layer as an intermediate layer, and an aluminum oxide-coating layer is formed on the surface of the intermediate layer, the resulting material has excellent peeling resistance and adhesiveness whereby a cutting tool having an elongated lifetime can be obtained.

That is, the aluminum oxide-coated tool member of the present invention comprises a substrate, an intermediate layer containing elements of Al (aluminum), Ti (titanium), O (oxygen) and C (carbon) provided on the substrate and an outer layer adjacent to said intermediate layer, wherein said outer layer comprises aluminum oxide, and said intermediate layer comprises at least one layer selected from the group consisting of a single-phase layer of a composite carboxide containing Ti and Al, and a complex-phase layer in which at least two selected from the group consisting of titanium carbide, titanium nitride, titanium oxide, titanium carbonitride, titanium carboxide, titanium nitroxide, titanium carbonitroxide, aluminum oxide, aluminum nitride, aluminum nitroxide, aluminum carboxide, aluminum oxynitrocarbide, a composite nitride containing Ti and Al, a composite oxide containing Ti and Al, a composite carboxide containing Ti and Al, a composite nitroxide containing Ti and Al, and a composite carbonitroxide containing Ti and Al are dispersed.

DESCRIPTION OF THE PREFERRED EMBODIMENTS

The substrate in the coated tool member of the present invention comprises a metal member, a sintered alloy or a ceramics sintered body which endures the temperature at which coating films are coated on the substrate. More specifically, there may be mentioned, for example, a metal member such as a stainless steel, heat-resistant alloy, high speed steel, die steel, Ti alloy and Al alloy; a sintered alloy such as a hard alloy, cement and sintered high speed steel; a ceramics sinered body such as an $Al_2O_3$ series sintered body, $Si_3N_4$ series sintered body, Sialon series sintered body and $ZrO_2$ series sintered body. Among these materials, when it is used as a cutting tool or a wear resistant tool, preferred is a substrate of hard alloy, particularly a substrate of hard alloy comprising 4 to 12% by weight of a binder phase mainly comprising Fe group metals, and the reminder being 10% by weight or less of tungsten carbide or a compound mainly comprising tungsten carbide and at least one cubic crystal structure compound selected from the group consisting of a carbide of Group 4b (Ti, Zr, Hf), 5b (Ta, Nb, V) or 6b (W, Cr, Mo) metal of the Periodic Table or mutual solid solutions thereof.

As an intermediate layer provided on the above-mentioned substrate, there may be mentioned, for example, by chemical formulae, an intermediate layer comprising a single-phase layer of (Ti,Al) (C,O) or (Ti,Al,M) (C,O); a complex-phase layer in which two or more selected from the group consisting of TiC, TiN, TiO, $TiO_2$, Ti(C,N), Ti(C,O), Ti(N,O), Ti(C,N,O), $Al_2O_3$, AlN, Al(O,N), Al(O,C), Al(O,C,N), (Ti,Al)O, (Ti,Al)N, (Ti,Al)(C,O), (Ti,Al)(N,O), (Ti,Al)(C,N,O), (Ti,Al,M)(C,O), (Ti,Al,M) (N,O) and (Ti,Al,M) (C,N,O) are uniformly dispersed, or a laminated layer in which the single-phase layer and the complex-phase layer are optionally laminated. In the above formulae, M represents at least one metal or semi-metal other than Ti and Al, and preferably a Group 4b, 5b or 6b metal of the Periodic Table or an Si semi-metal element. When the intermediate layer comprises a laminated layer, the intermediate layer may comprise at least two layers selected from the group consisting of the single-phase layer and the complex-phase layer with any optional combination such as two different single-phase layers; the single-phase layer and the complex-phase layer; two different complex-phase layers; three layers of the single-phase layer, the complex-phase layer and the single-phase layer in this order; three layers of the complex-phase layer, the single-phase layer and the complex-phase layer; and the like. When the intermediate layer comprises a complex-phase layer, the complex-phase layer preferably contains both of titanium and aluminum.

The intermediate layer has a role of mainly heightening adhesiveness between the outer layer and the inner layer. The intermediate layer preferably has an average layer thickness of 0.05 to 3 $\mu$m, particularly preferably 0.1 to 2 $\mu$m in order to heightening peeling resistance between the outer layer and the inner layer. Also, the intermediate layer is preferably coated adjacent to the substrate to simplify the preparation steps. Moreover, it is preferred to interpose an inner layer between the substrate and the intermediate layer as a medium for heightening adhesiveness therebetween. Furthermore, it is also preferred that the elements constituting the intermediate layer are present in inclined contents, that is, amounts of elements of Al (aluminum) and O (oxygen) are gradually increased toward the interface of the outer layer while amounts of titanium (Ti) and C (carbon) are gradually increased toward the substrate direction, since there are effects of heightening adhesiveness at the interfaces adjacent to the intermediate layer and of decreasing strain due to difference in thermal expansion.

The inner layer to be interposed between the intermediate layer and the substrate is preferably a single-phase layer or a laminated layer of at least two layers selected from the group consisting of titanium, titanium carbide, titanium nitride, titanium carbonitride, titanium carboxide, titanium nitroxide, titanium carbonitroxide, a composite nitride containing Ti and Al, a composite carbide containing Ti and Al, a composite carbonitride containing Ti and Al, a composite nitroxide containing Ti and Al and a composite carbonitroxide containing Ti and Al, since adhesivenesses between interfaces of the substrate and the inner layer, and of the inner layer and the intermediate layer are heightened.

It is particularly preferred in the coated tool member of the present invention that a hard alloy or a cermet is used as a substrate and the above-mentioned inner layer is coated adjacent to the substrate since adhesivenesses between interfaces of the substrate and the inner layer, and of the inner layer and the intermediate layer are heightened whereby improvement in elongation of lifetime becomes remarkable when it is used as a cutting tool. The inner layer at this time has an effect of complementing wear resistance of the outer layer and the intermediate layer after these layers are partially wear out in addition to the above-mentioned role. However, the thickness of the inner layer is too thick, breakage in the layer is likely caused. Thus, an average layer thickness of the inner layer is preferably 5 to 20 $\mu$m. particularly preferably 1 to 18 $\mu$m. Also, when the inner layer comprises a single-phase layer or multi-layers of two or more selected from the group consisting of titanium carbide, titanium nitride, titanium carbonitride, titanium carboxide, titanium nitroxide and titanium carbonitroxide, it is particularly preferred, under the severe conditions at which a cutting tool is used, that the inner layer comprises a crystal structure which becomes a columnar crystal to the substrate surface since strength in the inner layer is excellent.

An outer layer of the aluminum oxide coated adjacent to the surface of the intermediate layer comprises a coating layer mainly comprising aluminum oxide which is crystallized in view of crystal structure. This outer layer is preferably a coated layer of an α-aluminum oxide which is particularly excellent in high temperature characteristics and stability at high temperature among the crystal aluminum oxides. As the other embodiments of the outer layer, in view of adhesiveness with the intermediate layer provided adjacent to the outer layer, it is preferably a coating layer of κ-aluminum oxide, a coating layer of a mixture of α-aluminum oxide and κ-aluminum oxide, a mixed coating layer containing α-aluminum oxide, a mixed coating layer containing κ-aluminum oxide or a mixed coating layer containing α-aluminum oxide and/or κ-aluminum oxide and amorphous aluminum oxide. An average layer thickness of the outer layer is preferably 0.5 to 12 μm, particularly preferably 1 to 10 μm in view of the film thickness which can develop the characteristics such as oxidation resistance, wear resistance and temperature adhesion resistance against a pair material such as a material to be cut. If the thickness of the outer layer is too thick, breakage in the layer is likely caused.

In the coated tool member of the present invention, when it is used in a cutting tool, etc., if the outer layer is substantially a layer directly contacting with a material to be cut, its effects can be sufficiently developed and a long lifetime can be accomplished. However, it is extremely difficult to judge whether it is before use or after use from the appearance in which the outer layer is coated, and it is important particularly for a slow away tip among the cutting tools to be quite obvious whether it is before or after use since a plural number of blade tip corners are used. Thus, it is preferred to provide an outermost layer with a colored substance on the surface of the outer layer so that difference before or after use becomes clear.

The outermost layer with a colored substance preferably has properties that it is not peeled at the handling of a product before use such as packaging the product, installation and for practical use, and it is peeled at the time of contacting with a material to be cut. The outermost layer preferably comprises a yellow or gold colored substance since the blade tip corner of the tool member according to the present invention after use is a black series color so that it can easily make a distinction between the blade tip corner before use and the blade tip corner after use. The outermost layer may comprise a single-phase layer or a multiple layer of a material selected from the group consisting of titanium nitride, titanium carbonitride, titanium nitroxide, titanium carbonitroxide, zirconium nitride and tantalum nitride. Among them, titanium nitride is most preferred since it is easy in forming a film, has a decorative effect as a product and easy in making a distinction between the material before and after use due to its clear color. An average layer thickness of the outermost layer is preferably 0.05 to 3 μm, particularly preferably 0.1 to 2 μm for accomplishing the above object and for forming the film within a short period of time. The intermediate layer, outer layer, inner layer and outermost layer as mentioned above in detail may comprise a stoichiometric composition or a non-stoichiometric composition, and substantially comprises a non-stoichiometric composition.

In the coated tool member of the present invention, as a substrate, there may be used a conventionally available material including a metal member such as a stainless steel, heat-resistant alloy, high speed steel, die steel, Ti alloy and Al alloy; a sintered alloy such as a hard alloy, cermet and sintered high speed steel; a ceramics sinered body such as an $Al_2O_3$ series sintered body, $Si_3N_4$ series sintered body, Sialon series sintered body and $ZrO_2$ series sintered body. Among these materials, preferred is a substrate of hard alloy, particularly a substrate of hard alloy comprising 3 to 20% by weight of a binder phase mainly comprising cobalt and/or nickel, and 80 to 97% by weight of a hard phase comprising tungsten carbide or a compound mainly comprising tungsten carbide and at least one cubic crystal structure compound selected from the group consisting of a carbide, carbonitride or carboxide of Group 4b (Ti, Zr, Hf), 5b (V, Nb, Ta) or 6b (Cr, Mo, W) metal of the Periodic Table, or mutual solid solutions thereof. The coated tool member of the present invention can be prepared by subjecting the surface of the above-mentioned substrate to polishing, ultrasonic wave washing, organic solvent washing, etc. depending on necessity, and then, coating a coating layer on the substrate by a conventionally employed chemical vapor deposition method (CVD method), physical vapor deposition method (PVD method) or plasma CVD method.

In the coated tool member of the present invention, the intermediate layer has a function of heightening adhesiveness with the outer layer and a function of relaxing residual stress at the interface between the respective layers of the coated layers and the neighbor of the interface between the substrate and the coated layer. In the substrate comprising a hard alloy or cermet, when the coated layers of an inner layer, an intermediate layer and an outer layer are provided on the surface of the substrate, optimization occurs in relaxation of difference in thermal expansions between the respective layers and between the respective interfaces so that peeing resistance of the coated layer is further improved. As a result, the coated layer has a function of improving strength, fracture toughness value and wear resistance of the whole coated layers.

EXAMPLES

Example 1

As a substrate, a hard alloy comprising 85% WC-2% TiC-1% TiN-3% TaC-1% NbC-8% Co (% by weight) was used. The shape of the substrate was a rhombus, a relief surface: 0°, a thickness: 4.76 mm, a corner radius: 0.8 mm, and it was made a hole-attached slow away tip for clamp the cutting blade of which is applied to a horning processing. The surface of the substrate was washed with an organic solvent and dried, then placed in a chamber of a CVD device by using a tool which can coat the relief surface and a rake surface simultaneously. As the coating layer, a first inner layer adjacent to the substrate, a second inner layer, an intermediate layer, an outer layer and an outermost layer are successively coated on a substrate in this order to prepare present products 1 to 4. Preparation conditions such as a reaction gas composition, a reaction gas pressure and a reaction temperature at this time are shown in Table 1. Also, as a comparative purpose, in the same manner as in the preparation conditions of the present products 1 to 4 except for changing the coating conditions of the third layer which corresponds to the intermediate layer, a comparative product 1 was prepared.

The respective coating layers of the present products 1 to 4 and comparative product 1 thus obtained were analyzed by an X-ray diffraction device, a scanning type electron microscope, an optical microscope and an EDS device, respectively and the results of the components and film thicknesses of the respective coating layers are shown in Table 2.

Then, by using the present products 1 to 4 and the comparative product 1, wet intermittent cutting tests were carried out under the following conditions. That is, cutting conditions employed are: a material to be cut; four rods with grooves of a carbon steel material (a material corresponding to International Standard: ISO C45, The United States Steel Association: AISI 1045, or Japanese Industrial Standard: JIS S45C), a cutting rate; 150 m/min, feed; 0.3 mm/rev, cutting length; 2.0 mm and using a water-soluble cutting oil. The results of the wet intermittent cutting tests are shown in Table 3 by measuring a number of impacts added until the tool has had it by peeling of the coating layer or the like. The intermediate layer of the present product 1 shown in Table 3 is a solid solution, and those of the present products 2, 3 and 4 are complex-phase layers in which aluminum oxide is dispersed. The aluminum oxide layer in Example 1 was a mixed aluminum oxide layer comprising α-aluminum oxide and κ-aluminum oxide.

TABLE 3

| Sample No. | Number of impacts | Damaged state of cutting blade |
|---|---|---|
| Present product 1 | 17,000 | Normal wear |
| Present product 2 | 18,000 | Normal wear |
| Present product 3 | 20,000 | Normal wear |
| Present product 4 | 20,000 | Normal wear |
| Comparative product 1 | 15,500 | Peel of outer layer, chipping present |

Example 2

In the same manner as in Example 1 except for using the coating conditions of the respective coating layers as shown in Table 4, present products 5 to 17 and comparative products 2 to 8 were obtained for the purpose of mainly comparing the effects of compositions of the intermediate layer and layer constitutions. These present products 5, 6–7, 8–9, 10–11, 12–13, 14–15 and 16–17 are each correspond to comparative products 2 to 8, respectively, except for the intermediate layer, and the same an alysis as in Example were carried out. The results are shown in Table 5. Also, by using the present products 5 to 17 and comparative products 2 to 8, the same cutting test as in Example 1 was carried out. When the number of impacts reached to 5,000 times, the surface of each tool was observed by a scanning type electron microscope and a peeling degree of the coating layer was obtained from the equation: (Peeled area of the coating layer at the tool relief surface)/(Area of cutting region at the tool relief surface) and the results are shown in Table 6. Moreover, the results of the cutting tests, i.e., a number of impacts added until the tool has had it of the present products 5 to 17 and the comparative products 2 to 8 were also shown in Table 6. Incidentally, the intermediate layers of the present products 8, 9, 14, 15, 16 and 17 comprise two layers of a single-phase layer and a complex-phase layer. These intermediate layers comprise the single-phase layer at the inner layer side and the complex-phase layer at the outer layer side. The aluminum oxide layer in Example 2 comprises substantially α-aluminum oxide.

TABLE 1

| Kind of respective layers | | Coating conditions of respective coating layers: Reaction gas composition (% by volume) | Reaction atmosphere: Pressure (Torr) | Reaction atmosphere: Temperature (° C.) |
|---|---|---|---|---|
| First inner layer | | 49% $H_2$-50% $N_2$-1% $TiCl_4$ | 300 | 900 |
| Second inner layer | | 42% $H_2$-40% $N_2$-15% $CH_4$-3% $TiCl_4$ | 150 | 1000 |
| Intermediate layer | Present product 1 | 95% $H_2$-3% CO-1% $TiCl_4$-1% $AlCl_3$ | 50 | 1000 |
| | Present product 2 | 92% $H_2$-3% CO-1% $TiCl_4$-4% $AlCl_3$ | 50 | 1000 |
| | Present product 3 | 92% $H_2$-3% CO-1% $TiCl_4$-4% $AlCl_3$ | 250 | 1000 |
| | Present product 4 | 92% $H_2$-1.5% CO-1.5% NO-1% $TiCl_4$-4% $AlCl_3$ | 250 | 1000 |
| | Comparative product 1 | 96% $H_2$-3% CO-1% $TiCl_4$ | 150 | 1000 |
| Outer layer | | 89% $H_2$-7% CO-4% $AlCl_3$ | 50 | 1000 |
| Outermost layer | | 57% $H_2$-40% $N_2$-3% $TiCl_4$ | 100 | 1000 |

TABLE 2

| Sample No. | Average layer thickness (μm) and composition of the respective layers: First inner layer | Second inner layer | Intermediate layer | Outer layer | Outermost layer |
|---|---|---|---|---|---|
| Present product 1 | 1-TiN | 7-Ti(C,N) | 0.3-(Ti,Al) (C,O) | 2-$Al_2O_3$ | 0.3-TiN |
| Present product 2 | 1-TiN | 7-Ti(C,N) | Complex-phase layer of 0.3-[(Ti,Al) (C,O)-$Al_2O_3$] | 2-$Al_2O_3$ | 0.3-TiN |
| Present product 3 | 1-TiN | 7-Ti(C,N) | Complex-phase layer of 0.3-[(Ti,Al) (C,O)-$Al_2O_3$] | 2-$Al_2O_3$ | 0.3-TiN |
| Present product 4 | 1-TiN | 7-Ti(C,N) | Complex-phase layer of 0.3-[(Ti,Ai) (C,N,O)-$Al_2O_3$] | 2-$Al_2O_3$ | 0.3-TiN |
| Comparative product 1 | 1-TiN | 7-Ti(C,N) | 0.3-Ti(C,O) | 2-$Al_2O_3$ | 0.3-TiN |

TABLE 4

| Kind of respective coating layers | Coating conditions of respective coating layers: Reaction gas composition (% by volume) | Reaction atmosphere: Pressure (Torr) | Reaction atmosphere: Temperature(° C.) |
|---|---|---|---|
| A: TiC layer | 82% $H_2$-15% $CH_4$-3% $TiCl_4$ | 150 | 1000 |
| B: TiN layer | 57% $H_2$-40% $N_2$-3% $TiCl_4$ | 100 | 1000 |
| C: Ti(C,N) layer | 42% $H_2$-40% $N_2$-15% $CH_4$-3% $TiCl_4$ | 150 | 1000 |
| D: Ti(C,O) layer | 94% $H_2$-3% CO-3% $TiCl_4$ | 100 | 1000 |
| E: (Ti,Al) (C,O) layer | 92% $H_2$-3% CO-1% $TiCl_4$-4% $AlCl_3$ | 50 | 1000 |
| F: Complex-phase layer of (Ti,Al) (C,O)-$Al_2O_3$ | 92% $H_2$-3% CO-1% $TiCl_4$-4% $AlCl_3$ | 150 | 1000 |
| G: Complex-phase layer of (Ti,Al) (C,N,O)-$Al_2O_3$ | 92% $H_2$-1.5% CO-1.5% NO-1% $TiCl_4$-4% $AlCl_3$ | 150 | 1000 |
| H: $Al_2O_3$ layer | 89% $H_2$-7% $CO_2$-4% $AlCl_3$ | 50 | 1000 |

TABLE 5

| Sample No. | Average iayer thickness ($\mu$m) and composition of the respective layers: First inner layer | Second inner layer | Intermediate layer | Outer layer | Outermost layer |
|---|---|---|---|---|---|
| Present product 5 | 1-TiN | — | 0.1-(Ti,Al) (C,O) layer | 1-$Al_2O_3$ | 0.1-TiN |
| Present product 6 | 1-TiN | 9-Ti(C,N) | 1-[(Ti,Ai)(C,O) + $Al_2O_3$] layer | 2-$Al_2O_3$ | 0.3-TiN |
| Present product 7 | 1-TiN | 9-Ti(C,N) | 1-[(Ti,Al) (C,N,O) + $Al_2O_3$] layer | 2-$Al_2O_3$ | 0.3-TiN |
| Present product 8 | 1-TiN | 9-Ti(C,N) | 1-(Ti,Al) (C,O) layer and 1-[(Ti,Al) (C,O) + $Al_2O_3$] layer | 2-$Al_2O_3$ | 0.3-TiN |
| Present product 9 | 1-TiN | 9-Ti(C,N) | 1-(Ti,Al) (C,O) layer and i-[(Ti,Al) (C,N,O) + $A_2O_3$] layer | 2-$Al_2O_3$ | 0.3-TiN |
| Present product 10 | 1-TiN | 17-Ti(C,N) | 0.5-[(Ti,Ai)(C,O) + $Al_2O_3$] layer | 1-$Al_2O_3$ | 0.5-TiN |
| Present product 11 | 1-TiN | 17-Ti(C,N) | 0.5-[(Ti,Al) (C,N,O) + $Al_2O_3$] layer | 1-$Al_2O_3$ | 0.5-TiN |
| Present product 12 | 1-TiN | 7-Ti(C,N) | 0.5-[(Ti,Al) (C,O) + $Al_2O_3$] layer | 10-$Al_2O_3$ | 1-TiN |
| Present product 13 | 1-TiN | 7-Ti(C,N) | 5-[(Ti,Al) (C,N,O) + $Al_2O_3$] layer | 10-$Al_2O_3$ | 1-TiN |
| Present product 14 | 1-TiN | 9-Ti(C,N) | 1-(Ti,Al) (C,O) layer and 1-[(Ti,Al) (C,O) + $Al_2O_3$] layer | 2-$Al_2O_3$ | 2-TiN |
| Present product 15 | 1-TiN | 9-Ti(C,N) | 1-(Ti,Al) (C,O) layer and i-[(Ti,Al) (C,N,O) + $Al_2O_3$] layer | 2-$Al_2O_3$ | 2-TiN |
| Present product 16 | 1-TiN | 9-TiC | 1-(Ti,Al) (C,O) layer and 1-[(Ti,Al) (C,O) + $Al_2O_3$] layer | 2-$Al_2O_3$ | 0.3-TiN |
| Present product 17 | 1-TiN | 9-TiC | 1-(Ti,Al) (C,O) layer and i-[(Ti,Al) (C,N,O) + $Al_2O_3$] layer | 2-$Al_2O_3$ | 0.3-TiN |
| Comparative product 2 | 1-TiN | — | 0.1-Ti(C,O) layer | 1-$Al_2O_3$ | 0.1-TiN |
| Comparative product 3 | 1-TiN | 9-Ti(C,N) | 1-Ti(C,O) layer | 2-$Al_2O_3$ | 0.3-TiN |
| Comparative product 4 | 1-TiN | 9-Ti(C,N) | 2-Ti(C,O) layer | 2-$Al_2O_3$ | 0.3-TiN |
| Comparative | 1-TiN | 17- | 0.5-Ti(C,O) layer | 1-$Al_2O_3$ | 0.5-TiN |

TABLE 5-continued

| Sample No. | Average layer thickness (μm) and composition of the respective layers | | | | |
|---|---|---|---|---|---|
| | First inner layer | Second inner layer | Intermediate layer | Outer layer | Outer-most layer |
| product 5 | | Ti(C,N) | | | |
| Comparative product 6 | 1-TiN | 7-Ti(C,N) | 0.5-Ti(C,O) layer | 10-$Al_2O_3$ | 1-TiN |
| Comparative product 7 | 1-TiN | 9-Ti(C,N) | 2-Ti(C,O) layer | 2-$Al_2O_3$ | 2-TiN |
| Comparative product 8 | 1-TiN | 9-TiC | 2-Ti(C,O) layer | 2-$Al_2O_3$ | 0.3-TiN |

TABLE 6

| Sample No. | Peeling degree of coated layer (%) | Number of impacts until breakage | Sample No. | Peeling degree of coated layer (%) | Number of impacts until breakage |
|---|---|---|---|---|---|
| Present product 5 | 10 | 16,400 | Comparative product 2 | 65 | 11,500 |
| Present product 6 | 7 | 18,100 | Comparative product 3 | 54 | 13,800 |
| Present product 7 | 7 | 18,000 | Comparative product 4 | 47 | 15,600 |
| Present product 8 | 5 | 20,200 | Comparative product 5 | 56 | 12,700 |
| Present product 9 | 5 | 20,300 | Comparative product 6 | 58 | 12,900 |
| Present product 10 | 8 | 17,300 | Comparative product 7 | 47 | 15,700 |
| Present product 11 | 8 | 17,500 | Comparative product 8 | 51 | 14,300 |
| Present product 12 | 8 | 17,700 | | | |
| Present product 13 | 8 | 17,400 | | | |
| Present product 14 | 5 | 20,500 | | | |
| Present product 15 | 5 | 20,100 | | | |
| Present product 16 | 6 | 19,600 | | | |
| Present product 17 | 6 | 19,800 | | | |

Example 3

In the same manner as in Example 2 except for using an arc ion plating device in place of the chemical deposition device used in Example 2 and changing the coating conditions of the coating layer to those shown in Table 7, coated tool members of present products 18 to 27 and comparative products 9 to 13 were obtained. The thus obtained coating layers of the present products 18 to 27 and comparative products 9 to 13 were analyzed in the same manner as in Example 2 and the results are shown in Table 8. Also, by using the present products 18 to 27 and comparative products 9 to 13, peeling degree of the coated layers and a number of impacts until the product broken in the cutting tests were measured, the results of which are shown in Table 9. Incidentally, the intermediate layers of the present products 18 to 27 in Table 8 comprise the laminated structure as in the intermediate layers of the present product 8 or the like in the above-mentioned Table 5.

TABLE 7

| Kind of respective coating layer | Coating conditions of respective coating layers | | |
|---|---|---|---|
| | Bias voltage (V) | Vacuum degree (Torr) | Arc current (A) |
| (Ti, Al)N | 30 | $2 \times 10^{-2}$ | 150 |
| (Ti, Al)C | 30 | $2 \times 10^{-2}$ | 150 |
| (Ti, Al) (C, N) | 30 | $2 \times 10^{-2}$ | 150 |
| (Ti, Al) (N, O) | 30 | $2 \times 10^{-2}$ | 150 |
| (Ti, Al) (C, N, O) | 30 | $2 \times 10^{-2}$ | 150 |

TABLE 8

| Sample No. | Average layer thickness (μm) and composition of the respective layers | | | |
|---|---|---|---|---|
| | Inner layer | Intermediate layer | Outer layer | Outer-most layer |
| Present product 18 | 5-(Ti,Al)N | 1-(Ti,Al) (C,O) layer and 1-[(Ti,Al) (C,O) + $Al_2O_3$] layer | 1-$Al_2O_3$ | 0.3-TiN |
| Present product 19 | 5-(Ti,Al)N | 1-(Ti,Al) (C,O) layer and 1-[(Ti,Al) (C,O,N) + $Al_2O_3$] layer | 1-$Al_2O_3$ | 0.3-TiN |
| Present product 20 | 5-(Ti,Al)C | 1-(Ti,Al) (C,O) layer and 1-[(Ti,Al) (C,O) + $Al_2O_3$] layer | 1-$Al_2O_3$ | 0.3-TiN |
| Present product 21 | 5-(Ti,Al)C | 1-(Ti,Al) (C,O) layer and 1-[(Ti,Al) (C,O,N) + $Al_2O_3$] layer | 1-$Al_2O_3$ | 0.3-TiN |
| Present product 22 | 5-(Ti,Al) (C,N) | 1-(Ti,Al) (C,O) layer and 1-[(Ti,Al) (C,O) + $Al_2O_3$] layer | 1-$Al_2O_3$ | 0.3-TiN |
| Present product 23 | 5-(Ti,Al) (C,N) | 1-(Ti,Al) (C,O) layer and 1-[(Ti,Al) (C,O,N) + $Al_2O_3$] layer | 1-$Al_2O_3$ | 0.3-TiN |
| Present product 24 | 5-(Ti,Al) (N,O) | 1-(Ti,Al) (C,O) layer and 1-[(Ti,Al)(C,O) + $Al_2O_3$] layer | 1-$Al_2O_3$ | 0.3-TiN |
| Present product 25 | 5-(Ti,Al) (N,O) | 1-(Ti,Al) (C,O) layer and 1-[(Ti,Al) (C,O,N) + $Al_2O_3$] layer | 1-$Al_2O_3$ | 0.3-TiN |
| Present product 26 | 5-(Ti,Al) (C,N,O) | 1-(Ti,Al)(C,O) layer and 1-[(Ti,Al)(C,O) + $Al_2O_3$] layer | 1-$Al_2O_3$ | 0.3-TiN |
| Present product 27 | 5-(Ti,Al) (C,N,O) | 1-(Ti,Al)(C,O) layer and 1-[(Ti,Al) (C,O,N) + $Al_2O_3$ ] layer | 1-$Al_2O_3$ | 0.3-TiN |
| Comparative product 9 | 5-(Ti,Al)N | 2-Ti(C,O) layer | 1-$Al_2O_3$ | 0.3-TiN |
| Comparative | 5-(Ti,Al)C | 2-Ti(C,O) layer | 1-$Al_2O_3$ | 0.3-TiN |

TABLE 8-continued

| Sample No. | Average layer thickness (μm) and composition of the respective layers: Inner layer | Intermediate layer | Outer layer | Outermost layer |
|---|---|---|---|---|
| product 10 | | | | |
| Comparative product 11 | 5-(Ti,Al)(C,N) | 2-Ti(C,O) layer | 1-$Al_2O_3$ | 0.3-TiN |
| Comparative product 12 | 5-(Ti,Al)(N,O) | 2-Ti(C,O) layer | 1-$Al_2O_3$ | 0.3-TiN |
| Comparative product 13 | 5-(Ti,Al)(C,N,O) | 2-Ti(C,O) layer | 1-$Al_2O_3$ | 0.3-TiN |

TABLE 9

| Sample No. | Peeling degree of coated layer (%) | Number of impacts until breakage | Sample No. | Peeling degree of coated layer (%) | Number of impacts until breakage |
|---|---|---|---|---|---|
| Present product 18 | 5 | 20,400 | Comparative product 9 | 49 | 15,500 |
| Present product 19 | 5 | 20,500 | Comparative product 10 | 52 | 14,900 |
| Present product 20 | 5 | 20,700 | Comparative product 11 | 56 | 14,600 |
| Present product 21 | 5 | 20,400 | Comparative product 12 | 53 | 15,700 |
| Present product 22 | 6 | 20,200 | Comparative product 13 | 61 | 14,700 |
| Present product 23 | 6 | 20,100 | | | |
| Present product 24 | 5 | 20,300 | | | |
| Present product 25 | 5 | 20,600 | | | |
| Present product 26 | 6 | 20,400 | | | |
| Present product 27 | 6 | 20,300 | | | |

The coated tool material of the present invention is excellent in peeling resistance of the coating layer as compared with the conventional coated tool member, and among the coated layers, peeling resistance of the aluminum oxide outer layer is particularly excellent. Accordingly, high hardness, oxidation resistance and temperature adhesion resistance possessed by the outer layer itself are sufficiently shown, particularly relationships between respective layers of the coating layers comprising the outer layer, the intermediate layer and the inner layer are well adapted in composition and differences in thermal expansions of the respective layers are relaxed whereby strain therebetween is well controlled. In combination with these mutual characteristics of the coating layers, toughness, wear resistance, thermal shock resistance, fracture resistance, hardness, oxidation resistance and temperature adhesion resistance are markedly improved, and as a result, the present invention has the effects that lifetime of the tool member measured by the cutting test is extremely elongated and efficiency in cutting processing is markedly improved.

What is claimed is:

1. An aluminum oxide coated tool member which comprises a substrate, an intermediate layer containing aluminum, titanium, oxygen and carbon as essential elements and which is provided on the substrate and an outer layer disposed over said intermediate layer, wherein said outer layer comprises aluminum oxide, and said intermediate layer comprises at least one of:

a single-phase layer of a composite carboxide containing titanium and aluminum, a complex-phase layer having dispersed therein at least two components selected from the group consisting of titanium carbide, titanium nitride, titanium oxide, titanium carbonitride, titanium carboxide, titanium nitroxide, titanium carbonitroxide, aluminum oxide, aluminum nitride, aluminum nitroxide, aluminum carboxide, aluminum oxynitrocarbide, a composite nitride containing titanium and aluminum, a composite oxide containing titanium and aluminum, a composite carboxide containing titanium and aluminum, a composite nitroxide containing titanium and aluminum, and a composite carbonitroxide containing titanium and aluminum, provided that the combination consisting of titanium nitride, aluminum nitride is excluded, and a laminated layer containing at least said single-phase layer and said complex-phase layer.

2. The aluminum oxide coated tool member according to claim 1, wherein said substrate is a hard alloy.

3. An aluminum oxide coated tool member which includes a substrate, an outer layer of aluminum oxide, and, an intermediate layer interposed between the substrate and the outer layer, the intermediate layer containing aluminum, titanium, oxygen and carbon as essential elements and comprising:

a single-phase layer of a composite carboxide containing titanium and aluminum; and a layer selected from one of:

a first complex-phase layer in which aluminum oxide is dispersed in a composite carboxide containing titanium and aluminum;

a second complex-phase layer in which aluminum oxide is dispersed in a composite carbonitroxide containing titanium and aluminum; and a laminated layer containing at least one of the first and second complex-phase layers.

4. An aluminum oxide coated tool member which includes a substrate, an outer layer of aluminum oxide, and, an intermediate layer interposed between the substrate and the outer layer, the intermediate layer containing aluminum, titanium, oxygen and carbon as essential elements and comprising:

a single-phase layer of a composite carboxide containing titanium and aluminum; and a layer selected from the group consisting of:

a complex-phase layer in which aluminum oxide is dispersed in a composite carboxide containing titanium and aluminum, and a complex-phase layer in which aluminum oxide is dispersed in a composite carbonitroxide containing titanium and aluminum.

5. The aluminum oxide coated tool member according to claim 1, wherein said intermediate layer contains high concentrations of aluminum and oxygen proximate an interface between said intermediate layer and the outer layer and contains high concentrations of titanium and carbon proximate an interface between said intermediate layer and the substrate.

6. The aluminum oxide coated tool member according to claim 1, wherein the intermediate layer has an average layer thickness of 0.05 to 3 μm.

7. The aluminum oxide coated tool member according to claim 1, wherein the outer layer has an average layer thickness of 0.5 to 12 μm.

8. The aluminum oxide coated tool member according to claim 1, further comprising an inner layer which is formed between the substrate and said intermediate layer and which comprises one of:

a single-phase layer, and a laminated layer of two or more layers of a material selected from the group consisting of titanium, titanium carbide, titanium nitride, titanium carbonitride, titanium carboxide, titanium nitroxide, titanium carbonitroxide, a composite nitride containing titanium and aluminum, a composite carbide containing titanium and aluminum, a composite carbonitride containing titanium and aluminum, a composite nitroxide containing titanium and aluminum, a composite carbonitroxide containing titanium and aluminum.

9. The aluminum oxide coated tool member according to claim 8, wherein the inner layer has an average layer thickness of 0.5 to 20 $\mu$m.

10. The aluminum oxide coated tool member according to claim 1, further comprising an outermost layer comprising a colored substance having an average layer thickness of 0.05 to 3 $\mu$m, which is formed on the surface of said outer layer.

11. The aluminum oxide coated tool member according to claim 1, wherein said aluminum oxide coated tool member is a cutting tool.

* * * * *